US006832450B1

(12) United States Patent
Shaharbani

(10) Patent No.: US 6,832,450 B1
(45) Date of Patent: Dec. 21, 2004

(54) FINGER GUARD

(76) Inventor: Nissim Shaharbani, 50 Weizmann Street, Kfar Sava 44351 (IL)

( * ) Notice: Subject to any disclaimer, the term of this patent is extended or adjusted under 35 U.S.C. 154(b) by 10 days.

(21) Appl. No.: 10/449,673

(22) Filed: Jun. 2, 2003

(51) Int. Cl.[7] ..... E05D 11/00
(52) U.S. Cl. ..... 49/383
(58) Field of Search ..... 49/383; 160/40, 160/235, 236, 229.1

(56) References Cited

U.S. PATENT DOCUMENTS 3,302,690 A * 2/1967 Hurd ..... 160/40
5,001,862 A * 3/1991 Albenda ..... 49/383
5,419,084 A * 5/1995 Sankey et al. ..... 49/383
6,643,980 B1 * 11/2003 Dorder et al. ..... 49/383

FOREIGN PATENT DOCUMENTS

DE 4207385 A1 * 9/1993 ..... E06B/7/28

* cited by examiner

*Primary Examiner*—Jerry Redman
(74) *Attorney, Agent, or Firm*—David Klein; Dekel Patent Ltd.

(57) ABSTRACT

A finger guard comprising a flexible member having two opposite edge portions, the flexible member having a folded configuration and a spread configuration, and a pair of attachment members, one being securable to a door and the other being securable to a door jamb, each of the attachment members comprising a receiving portion for pivotally receiving therein one of the edge portions of the flexible member, wherein the edge portions generally freely rotate in the receiving portions when the flexible member moves between the folded and spread configurations.

5 Claims, 1 Drawing Sheet

FINGER GUARD

FIELD OF THE INVENTION

The present invention relates generally to door guards and, more specifically, to door guards to prevent persons from getting their fingers pinched between the door and the doorjamb.

BACKGROUND OF THE INVENTION

One of the problems with hinged doors is that, as the door is swung open, a gap is formed between the edge of the door and the doorjamb. When the door is closed, the gap closes as the edge of the door moves into the gap. However, because of the mechanics of the door, the door itself becomes a lever arm wherein closing the door with only a small force can generate a substantial force at the edge of the door which can crush or break a child's finger located in the gap between the door and the door jamb. Small children are often unaware of the danger and may place their fingers in the gap between the door and the door jamb.

Various finger guards (or door guards, the terms being used interchangeably throughout) are known. However, some of the guards must be specially modified to fit the door or the door casing by placing the guard between the door and the doorjamb. Others have some type of protrusion which projects outward when the door is opened or closed. Still others have members that ride or wear against the door, causing damage to the door.

SUMMARY OF THE INVENTION

The present invention seeks to provide a finger guard for a door. In one preferred embodiment, the finger guard comprises a flexible member that may stretch to accommodate an open door, and fold to accommodate the closure of the door. The flexible member protects against persons getting their fingers pinched between the door and the door jamb.

Attachment members are provided that are secured to the door and door jamb. The attachment members have receiving portions for receiving therein edge portions of the flexible member. The edge portions may generally freely rotate in the receiving portions when the flexible member moves between the folded and spread configurations. This may prevent wear and tear on the flexible member.

There is thus provided in accordance with an embodiment of the present invention a finger guard comprising a flexible member having two opposite edge portions, the flexible member having a folded configuration and a spread configuration, and a pair of attachment members, one being securable to a door and the other being securable to a door jamb, each of the attachment members comprising a receiving portion for pivotally receiving therein one of the edge portions of the flexible member, wherein the edge portions generally freely rotate in the receiving portions when the flexible member moves between the folded and spread configurations. The edge, portions may be generally convexly rounded, and the receiving portions may be generally concavely rounded.

In accordance with an embodiment of the present invention the flexible member may be shaped like a bellows with arcuate knuckles at joints thereof.

BRIEF DESCRIPTION OF THE DRAWINGS

The present invention will be understood and appreciated more fully from the following detailed description taken in conjunction with the drawings in which.

DETAILED DESCRIPTION OF THE PREFERRED EMBODIMENT

Figure 1:
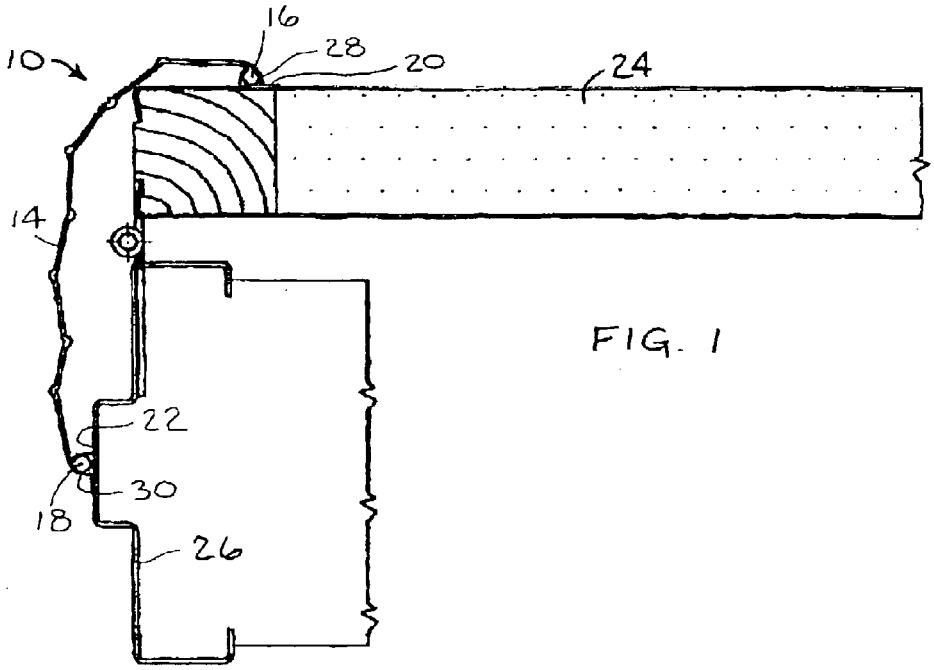
FIGS. 1 and 2 are simplified top-view sectional illustrations of a finger guard for a door, constructed and operative in accordance with a preferred embodiment of the present invention, in open door and closed door orientations, respectively.
Figure 3:
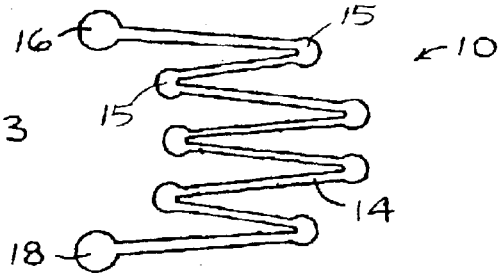
FIG. 3 is a simplified sectional illustration of the finger guard of FIGS. 1 and 2.

Reference is now made to FIGS. 1 and 3, which illustrate a finger guard 10 for a door 12, constructed and operative in accordance with a preferred embodiment of the present invention.

The finger guard 10 may comprise a flexible member 14 having two opposite edge portions 16 and 18, respectively. Flexible member 14 may be constructed of an elastomeric material, such as but not limited to, rubber, neoprene, silicone rubber and the like, or a flexible metal sheet, for example. Flexible member 14 may be shaped like a bellows, as is best seen in FIG. 3, with arcuate knuckles 15 at the joints of the bellows. Edge portions 16 and 18 may be generally convexly rounded, although other arbitrary shapes are also within the scope of the invention.

A pair of attachment members 20 and 22 are secured to a door 24 and a doorjamb 26, respectively. Attachment members 20 and 22 may be constructed of any sturdy material, such as but not limited to, an aluminum alloy, steel alloy or plastic. Attachment members 20 and 22 may be attached in any suitable manner, such as but not limited to, mechanical fasteners (e.g., screws, nails, rivets, etc.) or adhesive (e.g., adhesive strips, glue, etc.). Since finger guards are often necessary only when children are small, it may be desirable that finger guard 10 be easily removed from the door 24 and door jamb 26 when the children become aware of the dangers of placing their fingers between the door and the jamb 26. In such a case, certain kinds of adhesives may be preferred (e.g., an adhesive that is removable and does not leave marks after removal) or small screws may be preferred.

Attachment members 20 and 22 may comprise receiving portions 28 and 30, respectively, for pivotally receiving therein edge portions 16 and 18, respectively, of flexible member 14. The receiving portions 28 and 30 may be generally concavely rounded in accordance with the shape of edge portions 16 and 18, although, as stated previously, other arbitrary shapes are also within the scope of the invention. As seen best in FIG. 3, the convexly rounded knuckles 15 have different diameters than the convexly rounded edge portions 16 and 18. More specifically, the convexly rounded edge portions 16 and 18 are larger in diameter than the convexly rounded knuckles 15.

Figure 2:
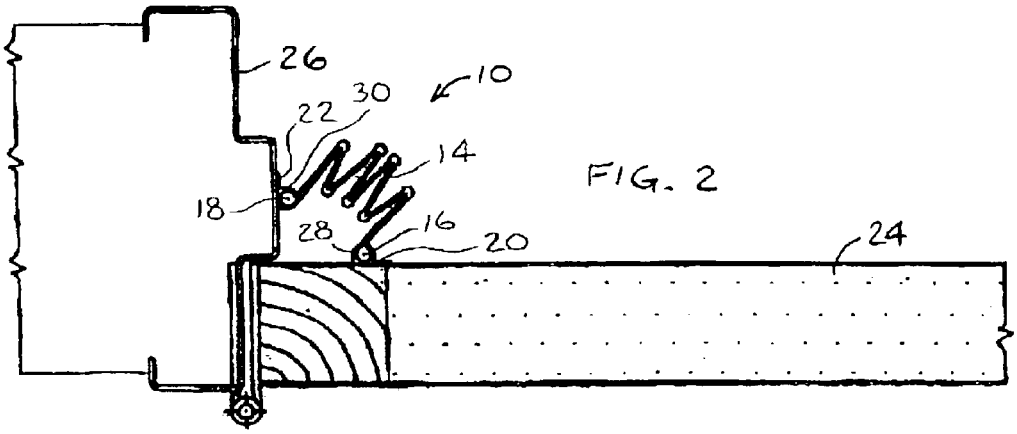

FIG. 1 illustrates finger guard 10 in a spread configuration with door 24 in an open orientation. The flexible member 14 may stretch to accommodate the open angle of the door 24. FIG. 2 illustrates finger guard 10 in a folded configuration with door 24 in a closed orientation. It is seen that flexible member 14 folds to accommodate the closure of the door 24. Edge portions 16 and 18 generally freely rotate in receiving portions 28 and 30, respectively, when flexible member 14 moves between the folded and spread configurations. Thus, in the present invention, no stress is applied to flexible member 14.

It will be appreciated by persons skilled in the art that the present invention is not limited by what has been particularly shown and described hereinabove. Rather the scope of the present invention includes both combinations and sub-combinations of the features described hereinabove as well as modifications and variations thereof which would occur to a person of skill in the art upon reading the foregoing description and which are not in the prior art.

What is claimed is:

1. A finger guard comprising:

a flexible member having two opposite edge portions, said flexible member having a folded configuration and a spread configuration, the edge portions being convexly rounded, said flexible member having convexly rounded knuckles at joints thereof; and a pair of attachment members, one being securable to a door and the other being securable to a door jamb, each of said attachment members comprising a concavely rounded receiving portion for pivotally receiving therein one of said edge portions of said flexible member, wherein said edge portions generally freely rotate in said receiving portions when said flexible member moves between said folded and spread configurations, wherein the convexly rounded knuckles and the convexly rounded edge portions have different diameters.

2. The finger guard according to claim 1, wherein said convexly rounded edge portions are larger in diameter than said convexly rounded knuckles.

3. A finger guard assembly comprising:

a flexible member having two opposite edge portions, said flexible member having a folded configuration and a spread configuration, the edge portions being convexly rounded, said flexible member having convexly rounded knuckles at joints thereof; and a pair of attachment members, one secured to a door and the other secured to a door jamb, each of said attachment members comprising a concavely rounded receiving portion for pivotally receiving therein one of said edge portions of said flexible member, wherein said edge portions generally freely rotate in said receiving portions when said flexible member moves between said folded and spread configurations, wherein the convexly rounded knuckles and the convexly rounded edge portions have different diameters.

4. The finger guard assembly according to claim 3, wherein said convexly rounded edge portions are larger in diameter than said convexly rounded knuckles.

5. The finger guard assembly according to claim 3, wherein said attachment members are secured to said door and said door jamb with an adhesive that is removable and does not leave marks after removal.

* * * * *